United States Patent [19]

Tsuda et al.

[11] Patent Number: 5,046,312

[45] Date of Patent: Sep. 10, 1991

[54] SWIVEL SPEED CONTROL CIRCUIT FOR WORKING VEHICLE

[75] Inventors: Akira Tsuda; Kazuyoshi Arii, both of Sakai, Japan

[73] Assignee: Kubota, Ltd., Osaka, Japan

[21] Appl. No.: 349,456

[22] Filed: May 8, 1989

[30] Foreign Application Priority Data

| | | | |
|---|---|---|---|
| Jul. 8, 1988 | [JP] | Japan | 63-171494 |
| Jul. 13, 1988 | [JP] | Japan | 63-176054 |
| Nov. 2, 1988 | [JP] | Japan | 63-278461 |
| Nov. 4, 1988 | [JP] | Japan | 63-279865 |
| Dec. 27, 1988 | [JP] | Japan | 63-333116 |

[51] Int. Cl.[5] ..... F15B 7/00

[52] U.S. Cl. ..... 60/493; 60/427; 60/465; 91/429; 91/457; 91/531

[58] Field of Search ..... 91/448, 531, 429, 459, 91/457; 60/493, 427, 465

[56] References Cited

U.S. PATENT DOCUMENTS

| | | | |
|---|---|---|---|
| 3,289,546 | 12/1966 | Erickson | 91/448 X |
| 4,552,503 | 7/1987 | Mouri et al. | 60/368 |
| 4,579,042 | 4/1986 | Neff | 91/448 X |
| 4,680,929 | 11/1985 | Mouri et al. | 414/687 |
| 4,706,549 | 11/1987 | Inagaki et al. | 91/448 |

FOREIGN PATENT DOCUMENTS

| | | | |
|---|---|---|---|
| 2853794 | 6/1979 | Fed. Rep. of Germany . | |
| 009781 | 1/1977 | Japan | 91/448 |
| 118303 | 7/1983 | Japan | 91/448 |
| 59-52031 | 3/1984 | Japan . | |
| 422459 | 4/1967 | Switzerland . | |
| 634109 | 3/1950 | United Kingdom . | |
| 2139382 | 7/1984 | United Kingdom . | |

*Primary Examiner*—Edward K. Look
*Assistant Examiner*—George Kapsalas
*Attorney, Agent, or Firm*—Edwin E. Greigg; Ronald E. Greigg

[57] ABSTRACT

A hydraulic circuit for controlling the deck swiveling speed of a working vehicle comprises a hydraulic actuator for driving the swivel deck, a flow control valve for controlling a rate of oil flow to the hydraulic actuator, and a direction control valve for switching an operating direction of the hydraulic actuator. The flow control and direction control valves are operatively connected to a swivel control lever. The greater amount of swivel control lever is operated toward a right or left swivel position, to the greater extent the flow control valve is shifted in a flow increasing direction. The direction control valve is operable to switch oil lines in response to an operation of the swivel control lever.

13 Claims, 12 Drawing Sheets

SWIVEL SPEED CONTROL CIRCUIT FOR WORKING VEHICLE

BACKGROUND OF THE INVENTION (1) Field of the Invention

The present invention relates to a hydraulic circuit structure for controlling the operating speed of a hydraulic actuator used on a construction machine or an agricultural or other working vehicle.

(2) Description of the Prior Art

A backhoe, which is one example of working vehicles, has a hydraulic motor, which is one example of hydraulic actuators, for driving a swivel deck. The operating speed of the hydraulic motor is controllable such that, the greater amount a manual swivel control lever is shifted from the neutral position to, say, a rightward swivel position, the faster the hydraulic motor rotates in a rightward swivel direction.

For controlling the operating speed of the hydraulic motor as above, the hydraulic circuit of the working vehicle includes an electromagnetically operable switch valve which is intermittently opened and closed under duty control, or an electromagnetic proportional reduction valve operable under voltage control. Thus, the greater amount the swivel control lever is shifted from the neutral position, the greater amount of oil is supplied to the hydraulic motor.

Such a control valve, generally, has three positions consisting of the rightward swivel position, neutral position and leftward swivel position. This control valve is urged to the neutral position, and includes solenoids for shifting the valve to the rightward and leftward swivel positions, respectively. A subtle difference in characteristics between the two solenoids results in a difference in the swiveling speed between rightward swiveling and leftward swiveling although the swivel control lever is shifted the same amount from the neutral position to either swivel position. Further, with this type of control valve, the flow rate control and directional control are effected simultaneously by a single mechanism. It is, therefore, impossible to effect half-port control and slow-speed control in a subtle and reliable manner.

SUMMARY OF THE INVENTION

The present invention has been made having regard to the state of the art noted above. It is the object of the present invention to provide a hydraulic circuit structure which eliminates the situation where the hydraulic actuator has different operating speeds in opposite directions although the swivel control lever is shifted the same amount in opposite directions, and which enables subtle and reliable half-port control and low-speed control.

In order to achieve the above object, a hydraulic circuit structure for a working vehicle according to the present invention comprises a hydraulic actuator, a first control valve for controlling a rate of oil flow to the hydraulic actuator, a second control mechanism connected in series to the first control valve for switching an operating direction of the hydraulic actuator, and a manual control device operatively connected to the first control valve and the second control mechanism, wherein the greater amount the manual control device is operated from a neutral position, to the greater extent the first control valve is shifted in a flow increasing direction, and the second control mechanism is operable to switch oil lines in a predetermined direction in response to an operation of the manual control device.

According to the above construction, whether the second control mechanism is shifted forward or backward from the neutral position, the amount of oil flow to or oil exhaust from the hydraulic actuator is determined by the first control valve acting as flow rate control means. Characteristically, therefore, this flow rate control means functions equally whether the second control mechanism is operated forward or backward.

The circuit structure, as noted above, does not control a valve acting as a directional and flow rate control valve, but includes the first control valve provided as the separate flow rate control means to effect flow rate control for forward and backward operations of the hydraulic actuator. Therefore, when the swivel control lever is operated by the same stroke forward or backward from the neutral position, the hydraulic actuator is operated forward or backward at the same speed corresponding to the stroke regardless of a difference between a forward side and a backward side of the control valve.

Such an allotment of functions enables a slow-speed operation under reliable half-port control.

In a preferred embodiment of the invention, the second control mechanism comprises a second control valve, the first control valve being operable after the second control valve is opened to a predetermined degree. The rate of flow from the second control valve substantially stabilizes when the second control valve opens to the predetermined degree. A stable and accurate flow rate control may be carried out by subsequently starting the flow rate control by means of the first control valve.

With a working vehicle having the above hydraulic circuit, when, for example, the swivel control lever is operated for right or left swiveling and returned to the neutral position during a swiveling movement of the deck, the second valve mechanism is immediately returned to neutral, thereby stopping oil supply and oil exhaust to/from the hydraulic actuator and bringing the swivel deck to a sudden stop. When the swivel deck heavy with a backhoe implement and other components stops suddenly, the swivel deck inevitably swings right and left under inertia adjacent a stopping position. In order to avoid this situation it is necessary to return the control lever slowly. In this sense, there is room for improvement.

In a preferred embodiment for achieving the above improvement, the second control mechanism includes a first switch valve for receiving pressure oil from a pump and supplying the pressure oil for forward rotation, and a second switch valve for receiving the pressure oil from the pump and supplying the pressure oil for backward rotation. The manual control device and the second control mechanism are interlocked such that, when one of the switch valves is shifted to an oil supplying direction, the one of the switch valves is retained in the oil supplying direction and, when the other switch valve is shifted to the oil supplying position, the one of the switch valve is shifted to a closed position. The manual control device is connected to a control unit for controlling the first control valve from a point of time at which the manual control device is returned to the neutral position, thereby to cause the first control valve to shift gradually in a flow reducing direction to a flow stopping position.

According to the above construction, when, for example, the manual control device is operated from the neutral position toward a forward swivel position, the first switch valve is shifted to the oil supplying side to operate the hydraulic actuator in the forward direction. When the manual control device is thereafter returned to the neutral position, the first switch valve is retained in the oil supplying side to keep supplying the pressure oil to the hydraulic actuator. Thus, from the point of time at which the manual control device is returned to the neutral position, the first control valve acting as the flow rate control means gradually reduces the flow rate to decelerate the hydraulic actuator. When the flow rate control means stops the oil supply, the hydraulic actuator also stops.

As described above, even if the swivel control lever acting as the manual control device is quickly returned to the neutral position, the hydraulic actuator stops slowly instead of stopping suddenly. The hydraulic actuator is stopped in a shock-free manner without a special operation such as a slow return to the neutral of the swivel control lever, which promotes safety.

When, for example, the manual control device is returned from the forward swivel side to the neutral position, the first switch valve is retained in the oil supplying side unless the manual control device is operated to the backward swivel side. At this time, the pressure oil keeps flowing at a constant rate to the first control valve acting as the flow rate control means. Consequently, the first control valve controls the operating speed of the hydraulic actuator easily and accurately.

In a further preferred embodiment, the second control mechanism includes delay means for shifting the second control mechanism to neutral after lapse of a predetermined time from a point of time at which the manual control device is operated to the neutral position, the first control valve being gradually shiftable in a flow reducing direction during the predetermined time.

As in the preceding embodiment, even when the manual control device such as the swivel control lever is returned quickly to the neutral position, the second control mechanism does not return to neutral immediately but returns to neutral with a delay. Consequently, the oil supply and oil exhaust to/from the hydraulic actuator are carried out for a predetermined time after the return to neutral of the manual control device. During this predetermined time, the operating speed of the hydraulic actuator keeps decelerating under control by the first control valve. The hydraulic actuator stops completely when the second control mechanism is shifted to neutral after the predetermined time.

As described above, the hydraulic actuator is decelerated to a smooth stop when the manual control device such as the swivel control lever is returned to the neutral position. Even if the manual control device is suddenly returned to the neutral position, the hydraulic actuator may be stopped with little or no shocks. This future assures increased safety.

Other features and advantages of the present invention will be apparent from the following description.

BRIEF DESCRIPTION OF THE DRAWINGS

The drawings show a working vehicle having a hydraulic circuit construction according to the present invention, in which.

DESCRIPTION OF THE PREFERRED EMBODIMENTS

Embodiments of the present invention will be described hereinafter with reference to the drawings.

Figure 1:
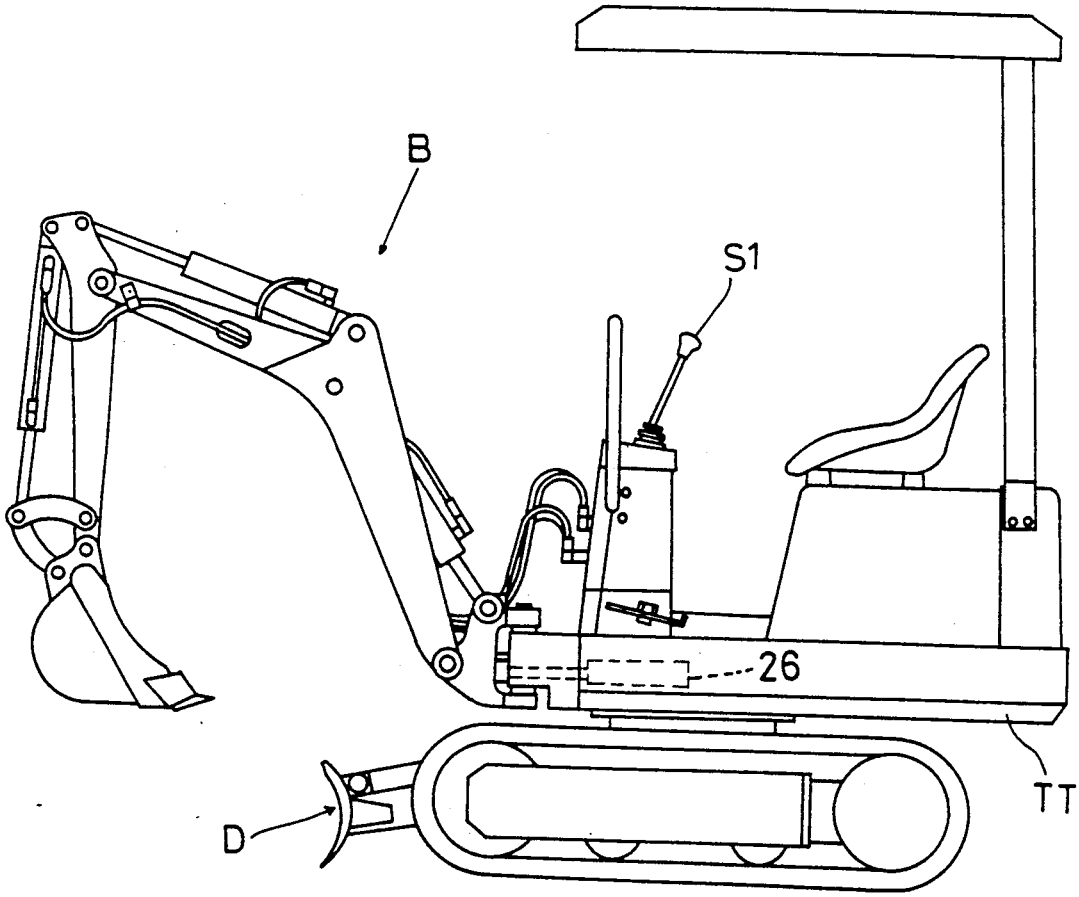
FIG. 1 is a side elevation of a backhoe.

FIG. 1 shows a backhoe as one example of working vehicles. The backhoe comprises a backhoe implement B, a dozer D and a swivel deck TT which are controllable by a hydraulic circuit embodying the present invention.

Figure 2:
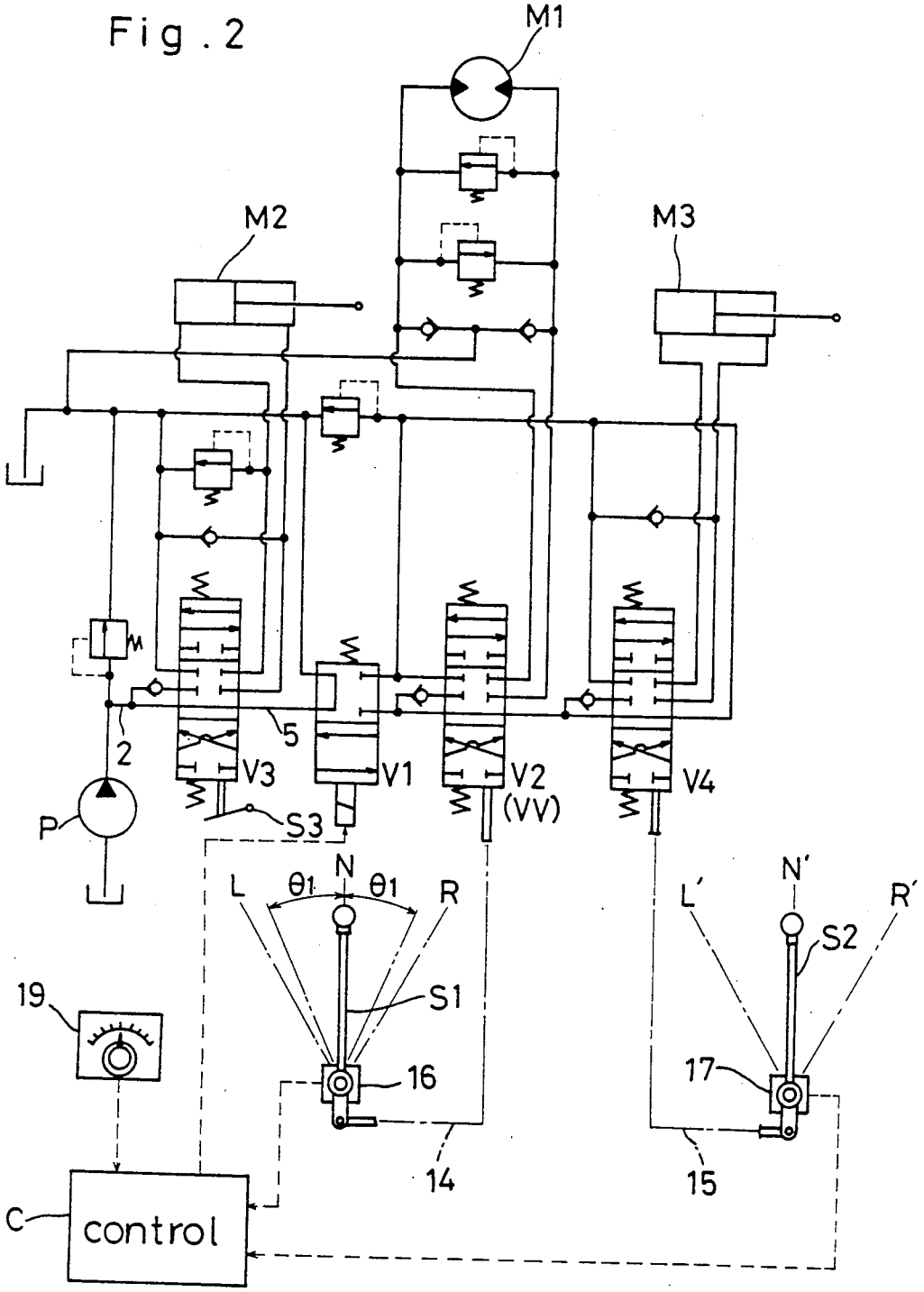
FIG. 2 is a circuit diagram of a first embodiment showing a hydraulic circuit including a hydraulic motor, control valves and a flow rate controlling switch valve, and an interlocking relationship between a first shift lever and the valves.

FIG. 2 shows a hydraulic circuit according to a first embodiment of the invention. In this circuit, pressure oil is supplied from a pump P through an oil line 2 to a spool-type third control valve V3 having three switching positions. The third control valve V3 is connected to a double-acting second hydraulic cylinder M2 for raising and lowering the dozer D. The third control valve V3 is mechanically operable by a third shift lever S3.

An oil line 5 extends from the third control valve V3 to a first control valve V1, a second control valve V2 and a fourth control valve V4 arranged in series. The first control valve V1 acts as flow rate control means.

The second control valve V2 acts as a second control mechanism VV connected to a hydraulic motor M1 acting as a hydraulic actuator for swiveling the swivel deck TT. The fourth control valve V4 is connected to a double-acting third hydraulic cylinder M3 for swinging the backhoe implement B. In this embodiment, the first control valve V1 comprises an electromagnetic switch valve.

The second and fourth control valves V2 and V4 are spool-type valves having three positions, respectively. The second and fourth control valves V2 and V4 are mechanically connected through link mechanisms 14 and 15 to a first and a second shift levers S1 and S2 acting as manual control devices, respectively. The first shift lever S1 has a right swivel maximum stroke position R and a left swivel maximum stroke position L respectively corresponding to opposite stroke ends of the spool (not shown) of the second control valve V2. The second shift lever S2 has a right swing maximum stroke position R' and a left swing maximum stroke position L' respectively corresponding to opposite stroke ends of the spool (not shown) of the fourth control valve V4.

Figure 3:
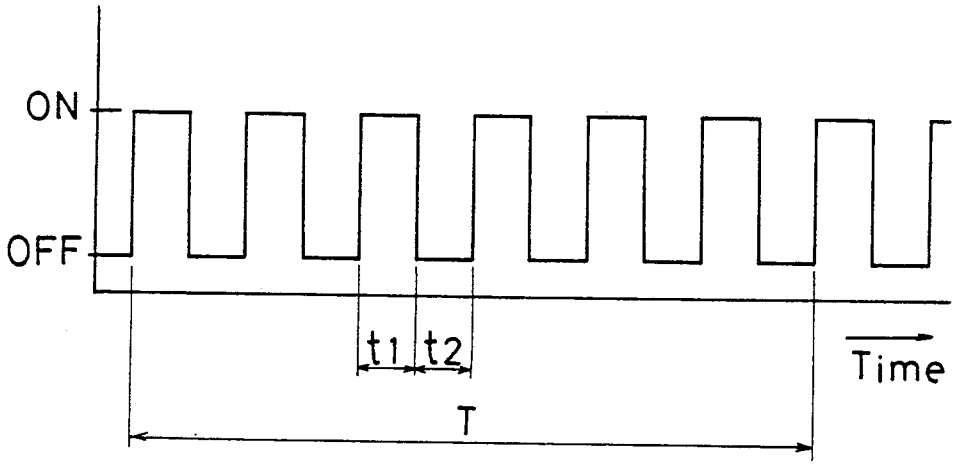
FIG. 3 is a time chart of a valve opening signal transmitted from a control unit to the switch valve.

Potentiometers 16 and 17 are provided at proximal ends of the first and second shift levers S1 and S2 for detecting pivoting angles thereof and transmitting detection signals to a control unit C. The control unit C transmits a control signal to the switch valve V1 to open and close the latter repeatedly. As shown in FIG. 3, the control signal is intermittently transmitted with ON periods of time t1 and OFF periods of time t2. This intermittent operation of the switch valve V1 controls flow rates to and from the second control valve V2, thereby to vary the operating speed of the hydraulic motor M1.

When the first shift lever S1 is rocked from the neutral position N toward the right or left swivel maximum stroke position R or L, the second control valve V2 is shifted to a right or left swivel side. At this time, the greater angle the first shift lever S1 pivots from the neutral position N, to the greater extent the sum total of the ON periods t1 becomes longer than the sum total of the OFF periods t2 within a predetermined time T in FIG. 3. As a result, the greater angle the first shift lever S1 pivots from the neutral position N, the faster turns the swivel deck. (The second control valve V2 becomes substantially fully open in the right or left swivel direction when the first shift lever S1 is slightly rocked from the neutral position N to the right or left swivel side.).

Since the switch valve V1 and second control valve V2 are connected in series, the same swivel speed is produced by rocking the first shift lever S1 through a predetermined angle $\theta 1$ to the right swivel side and to the left swivel side.

When the second shift lever S2 is operated while the swivel deck is stationary, this operation is detected by the potentiometer 17. In this case too, the switch valve V1 is shifted to the open position.

Figure 4A:
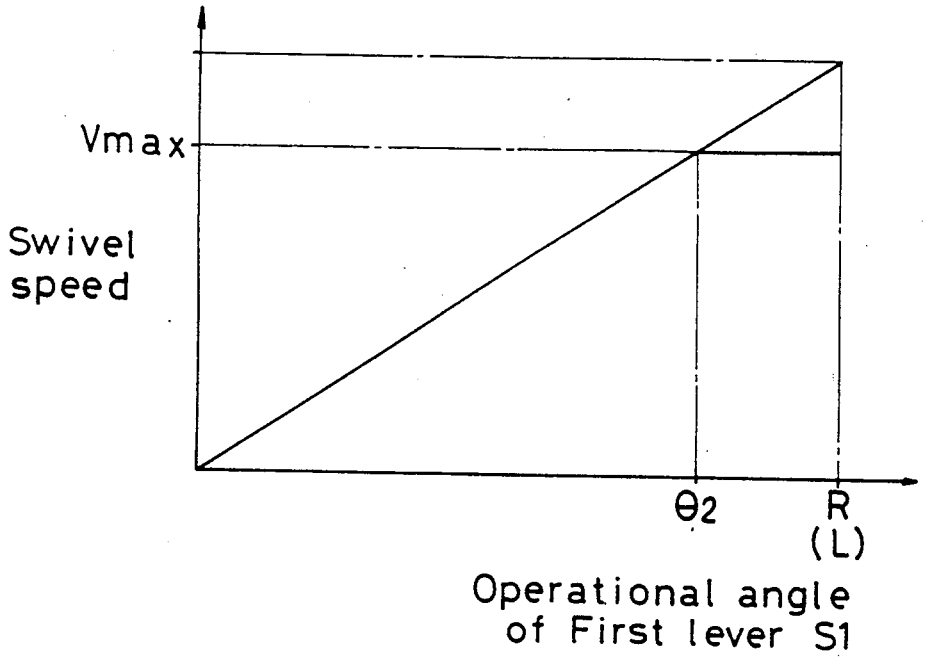
FIG. 4*a* is a view showing a relationship between the swivel speed of a swivel deck and the operational angle of the first shift lever in the first embodiment.
Figure 4B:
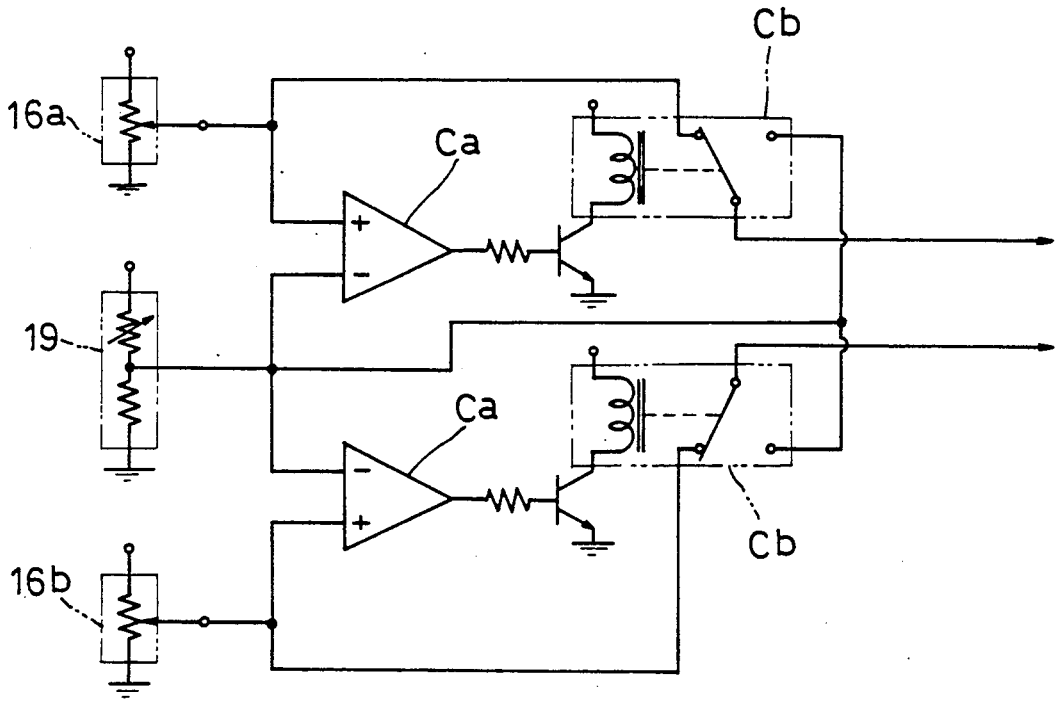
FIG. 4*b* is a view showing an electric circuit for enabling the swivel speed shown in FIG. 4*a*.

A setter 19 is connected to the control unit C for setting a maximum swivel speed Vmax of the swivel deck. The maximum swivel speed Vmax may be selected as desired as shown in FIG. 4*a*. The swivel speed does not exceed the maximum swivel speed Vmax even when the first shift lever S1 is operated through an angle greater than an angle $\theta 2$ corresponding to the maximum swivel speed Vmax. FIG. 4*b* shows an example of electric circuit for allowing this speed setting. The potentiometer 16 is shown therein as comprising slide-type right and left resistors 16*a* and 16*b* corresponding to the right and left operating directions, with the setter 19 shown as a variable resistor. The control unit C includes comparators Ca corresponding to the right and left lever positions and connected to relay switches Cb. This circuit provides the output shown in FIG. 4*a* based on outputs of the comparators Ca.

Figure 4C:
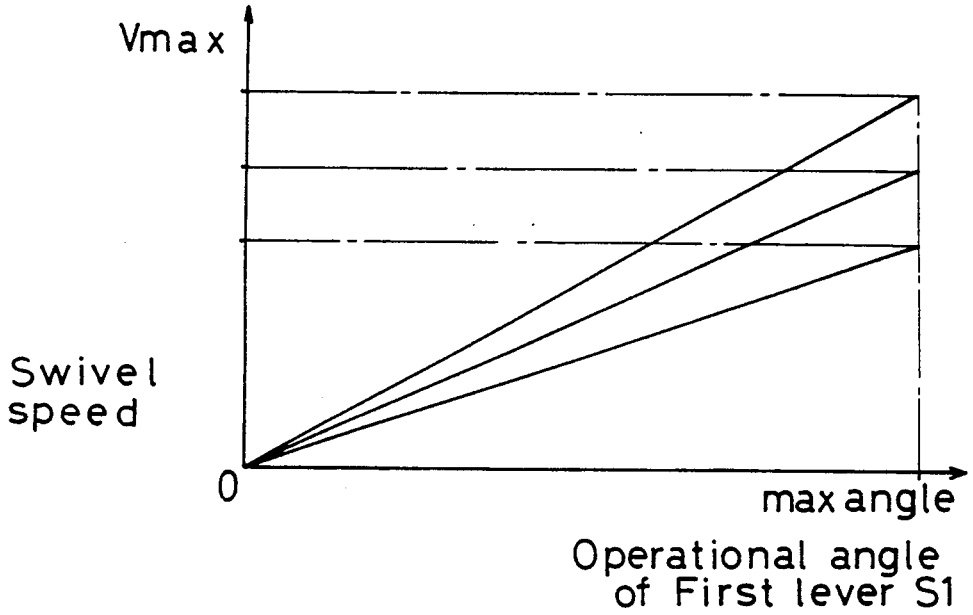
FIG. 4*c* is a view showing a different relationship between the swivel speed and the operational angle of the first shift lever.
Figure 4D:
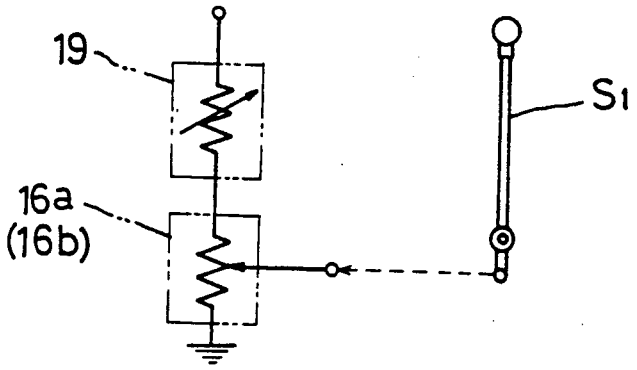
FIG. 4*d* is a view showing an electric circuit for enabling the swivel speed shown in FIG. 4*c*.

The maximum swivel speed Vmax may be set by a different method which provides the maximum swivel speed Vmax whenever the shift lever S1 is placed in a maximum operating position. FIG. 4*c* shows the relationship between the pivoting angle of the shift lever and the swivel speed according to this method. In this case, the setter 19 and potentiometer 16 are connected in series as shown in FIG. 4*d*. The shift lever and setter are interrelated such that a maximum voltage applied to the potentiometer is variable.

A second embodiment of the present invention will be described next. This embodiment provides a mechanism for setting an operating sequence between the first control valve V1 and second control mechanism VV, thereby to allow the swivel deck TT to swivel under swivel speed control with increased accuracy and reliability.

Figure 7:
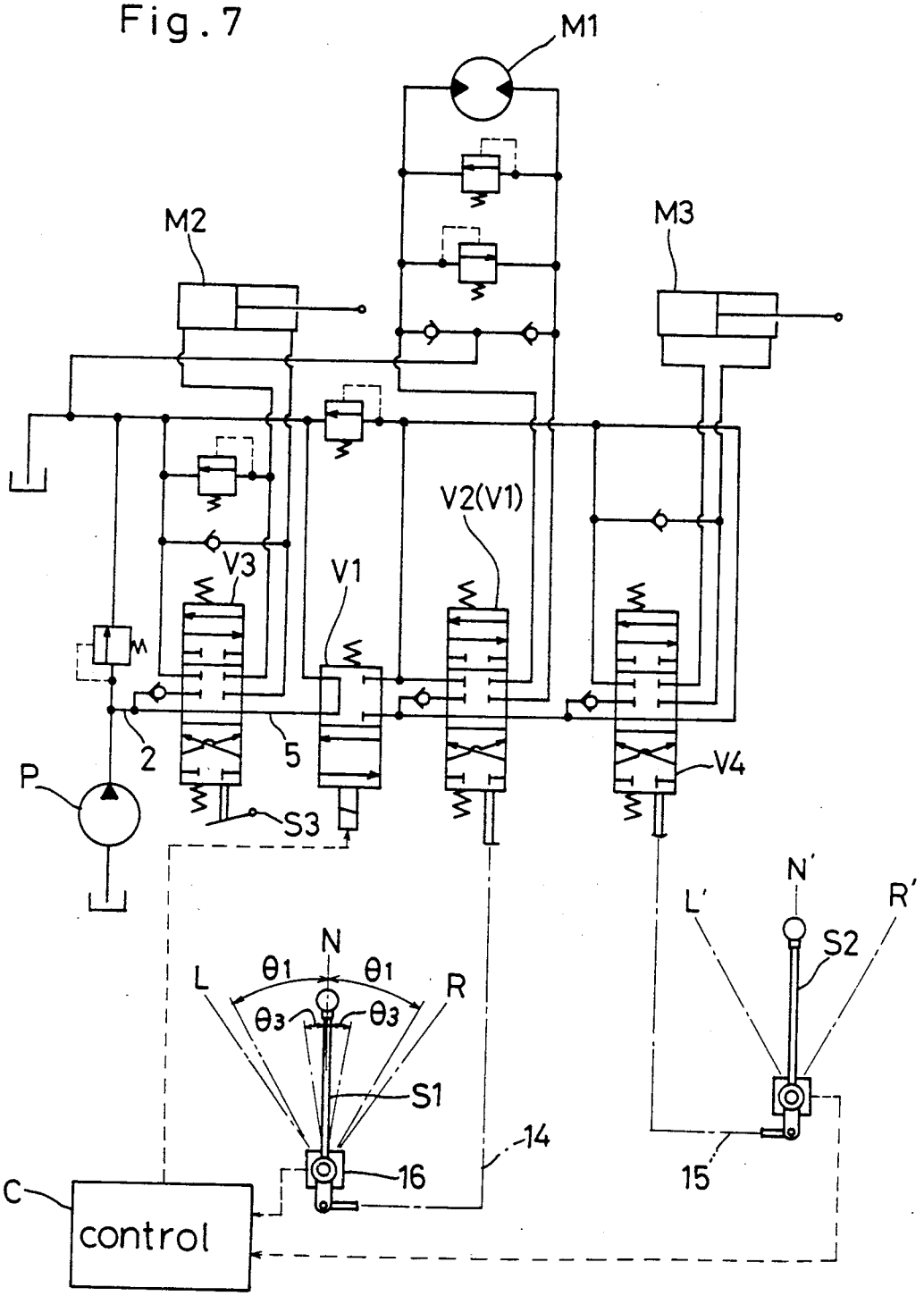
FIG. 7 is a diagram showing a hydraulic circuit according to a second embodiment and an interlocking relationship between the first shift lever and the valves.
Figure 8:
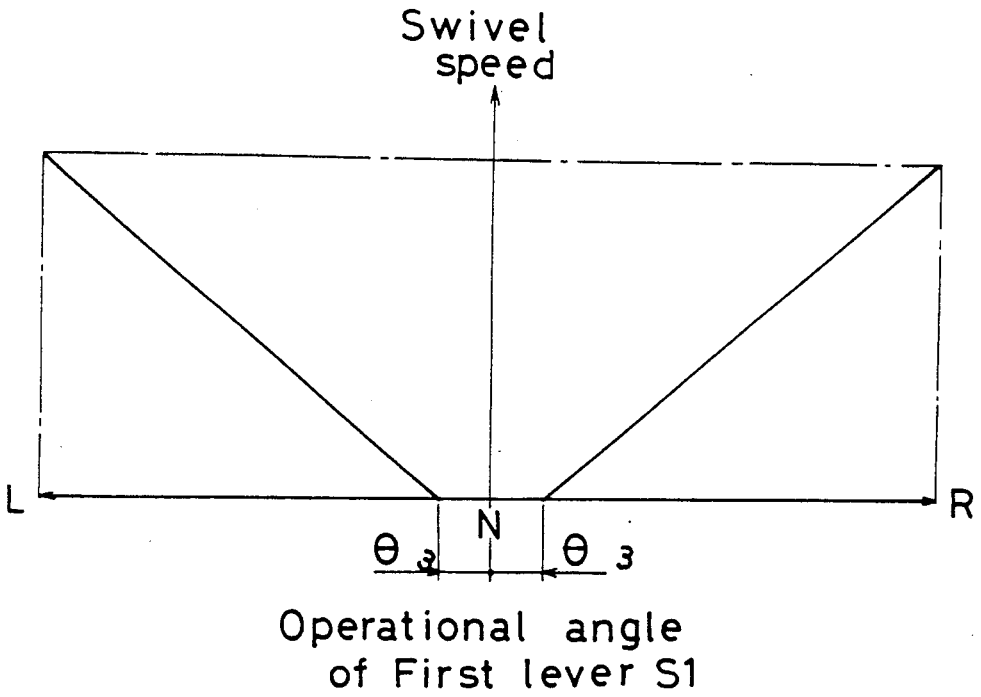
FIG. 8 is a view showing a relationship between the swivel speed of the swivel deck and the operational angle of the first shift lever in the second embodiment.

Referring to FIGS. 7 and 8, when the first shift lever S1 is within a predetermined angle $\theta 3$ from the neutral position N, the first control valve V1 is closed with the valve opening signal ON not transmitted thereto. The control unit C trasmits the valve opening signal ON only when the first shift lever S1 is rocked past predetermined angle $\theta 3$, that is to say after the second control mechanism VV operatively connected to the first shift lever S1 exceeds a predetermined opening degree. The first control valve V1 is thereby intermittently opened to allow the swivel deck to turn at the speed corresponding to the pivoting angle of the first shift lever S1.

As a result, the flow control for the first control valve V1 is started after the oil flow from the second control mechanism VV is substantially stabilized, thereby realizing a stable and accurate flow control.

Figure 9:
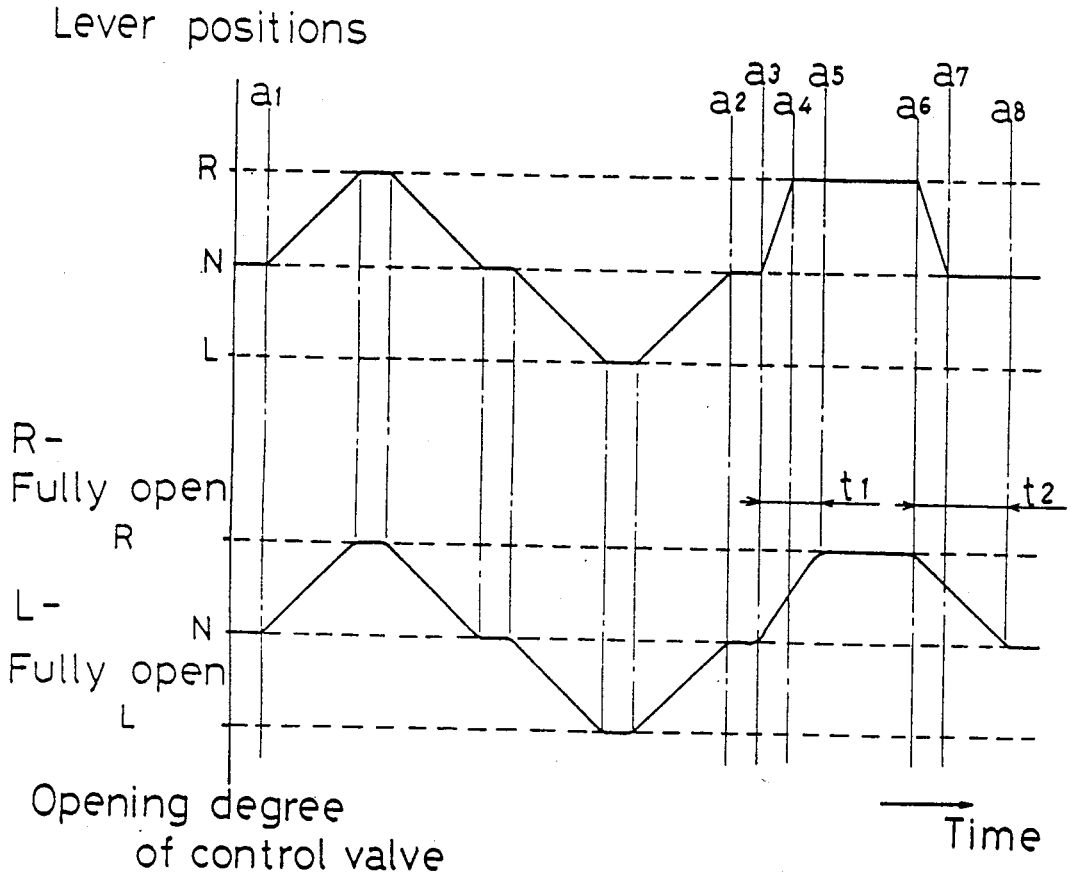
FIG. 9 is a view showing delays provided between the shift lever and control valve operations.

A control method will be described next, which eliminates shocks by delaying the operation of the control valve after a lever operation. This method may be executed in the simplest manner by providing time lags between the two operations as shown in FIG. 9. The lefthand side of FIG. 9 shows the valve operation effected according to the lever positions without time lags. The righthand side of FIG. 9 shows the control with time lags. References t1 and t2 indicates time lags which may be set for opening and closing the valve in the right swivel side, respectively. This method, however, necessitates a special control circuit.

The present invention also provides a hydraulic circuit structure for avoiding shocks due to a sudden stop of the swivel deck in a return swivel operation as noted hereinbefore.

Figure 10:
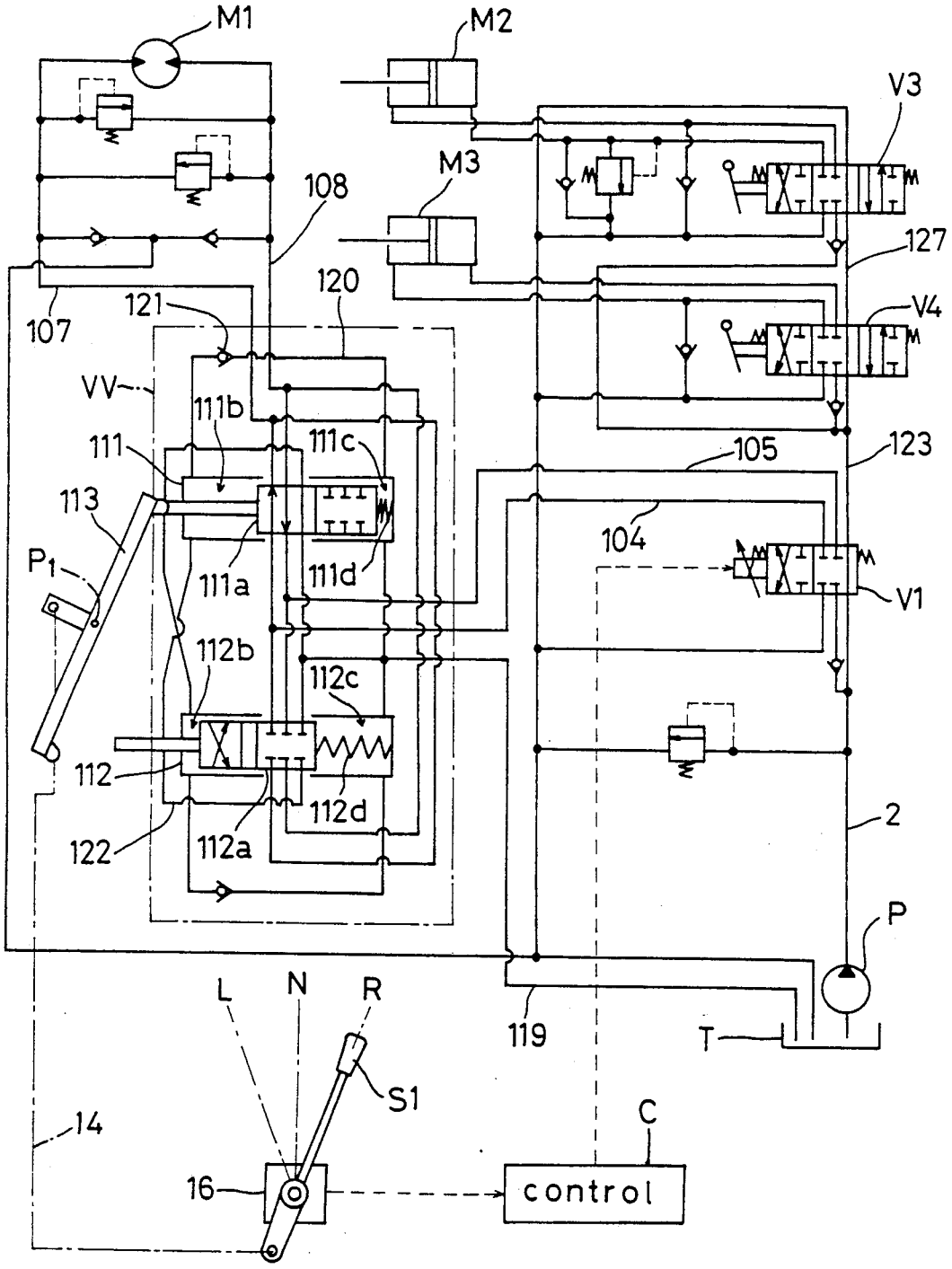
FIG. 10 is a diagram showing a hydraulic circuit according to a third embodiment and an interlocking relationship between the first shift lever and the valves.

FIG. 10 shows this structure which is a third embodiment of the invention, in which an oil line 2 extends from a pump P to a first control valve V1 acting as a flow control means. In this embodiment, the first control valve V1 comprises an electromagnetic proportional reduction valve. Two oil lines 104 and 105 extend from this proportional reduction valve V1 to a second control mechanism VV acting as an operating direction switching means. Further, two oil lines 107 and 108 extend from the second control mechanism VV to a hydraulic motor M1 acting as a double-acting hydraulic actuator. The hydraulic motor M1 drives the swivel deck TT to turn right and left.

As shown in FIG. 10, the second control mechanism VV includes a first switch valve 111 for supplying pressure oil to the hydraulic motor M1 to cause right swiveling of the deck TT, and a second switch valve 112 for supplying pressure oil to the hydraulic motor M1 to cause left swiveling. The oil line 104 which is a pressure oil supply line extending from the first control valve V1 is connected in parallel to the first and second switch valves 111 and 112. The first and second switch valves 111 and 112 include spools 111*a* and 112*a* defining left and right oil chambers 111*b*, 111*c*, 112*b* and 112*c*, respectively. The two spools 111*a* and 112*a* are urged by springs 111*d* and 112*d* to closed positions (leftward in the drawing), respectively.

A balance arm 113 is pivotably supported on an axis P1 for abutting on and pushing one of the spools 111*a* and 112*a*. The balance arm 113 is operatively connected through a link mechanism 14 to a first shift lever S1 acting as a manual control device. The first shift lever S1 has a potentiometer 16 disposed at a proximal end thereof for detecting a pivoting angle of the lever S1 and transmitting a detection signal to a control unit C.

According to the above construction, when, for example, the first shift lever S1 is rocked from a neutral position N towards a right swivel position R, the balance arm 113 pushes the spool 111*a* of the first switch valve 111 is pushed rightward in the drawing, thereby immediately placing the first switch valve 111 in a fully open position. At this time, the control unit C, in response to the detection signal received from the potentiometer 16, transmits a control signal to the first control valve V1 for effecting flow control. The greater angle the first lever S1 pivots toward the right swivel position R, the faster the swivel deck TT swivels rightward. Thus, the swiveling speed or the swivel deck TT is variable with the degree to which the operator rocks the first shift lever S1.

As the spool 111*a* of the first switch lever 111 is pushed rightward in the drawing with the rightward operation of the first shift lever S1, a resulting negative pressure draws pressure oil from a tank T through an oil line 119, the oil chamber 111*c* of the first switch valve 111 and an oil line 120 into the oil chamber 111*b* of the first switch valve 111. The oil line 120 includes a check valve 121 for preventing the pressure oil from flowing out of the oil chamber 111*b*. Consequently, the spool 111*a* of the first switch valve 111 is retained in an oil supplying position as shown in FIG. 10.

When the first shift lever S1 is returned from the position shown in FIG. 10 to the neutral position, only the balance arm 113 disengages from the spool 111*a*, leaving the first switch valve 111 retained in the oil supplying position (the position shown in FIG. 10). With the return operation of the first shift lever S1 to the neutral position N, the control unit C causes the first control valve V1 to gradually shift in a flow reducing direction toward a flow stopping position. As a result, the swivel deck TT gradually decelerates from the return operation to the neutral position N of the first shift lever S1, and stops without shocks.

When the first shift lever S1 is operated from the right swivel position R past the neutral position N to a left swivel position L, the balance arm 113 pushes the spool 112*a* of the second switch valve 112 to an oil supplying position rightward in FIG. 10. At this time, the pressure oil in the oil chamber 111*b* of the first switch valve 111 is exhausted through an oil line 122, the spool 112*a* of the second switch valve 112 and the oil line 119. Then the spring 111*d* pushes the spool 111*a* of the first switch valve 111 to a closed position leftward in FIG. 10. The same control operation takes place in the left swivel position L as in the right swivel position R.

Figure 11:
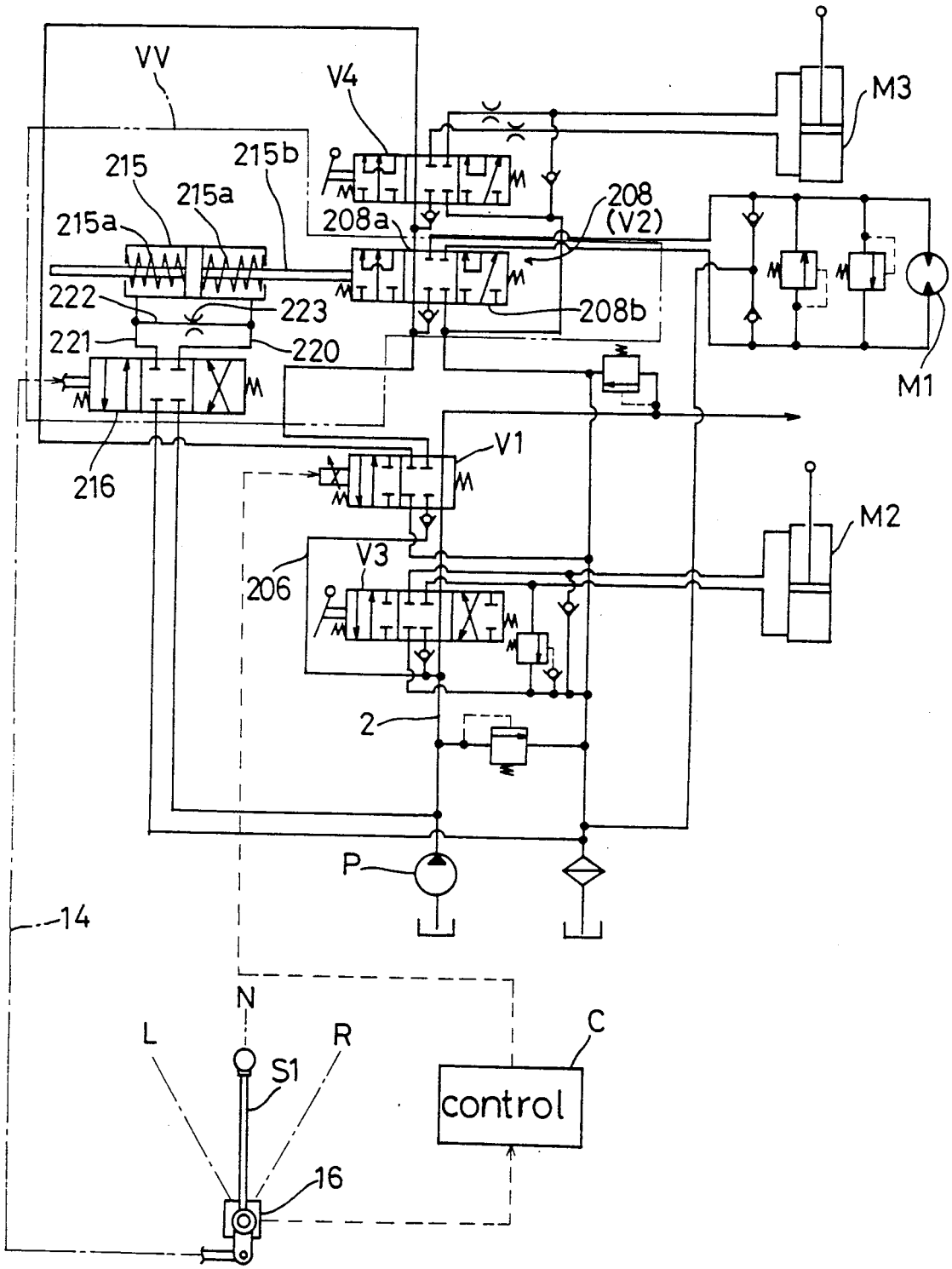
FIG. 11 is a diagram showing a hydraulic circuit according to a fourth embodiment and an interlocking relationship between the first shift lever and the valves.

A different hydraulic circuit structure for achieving the same object as above will be described next. FIG. 11 shows this structure which forms a fourth embodiment of the present invention. As shown, a first control valve V1, a second control valve V2 and a fourth control valve V4 are connected in series to an oil line 206 branched from an oil line 2. The first control valve V1 in this embodiment comprises an electromagnetic proportional reduction valve. As in the above embodiment, the second control valve 208 acts as direction control means. More particularly, the second control valve 208 determines the swiveling direction of the swivel deck TT by switching pressure oil supplying and exhausting directions for a hydraulic motor M1 which acts as a double-acting hydraulic actuator for driving the swivel deck TT to turn right and left. The first control valve V1 controls the rate of oil flow to the second control valve 208 for varying the swivel speed.

An interlocking structure for connecting the first and second control valves V1 and 208 to a first shift lever S1 acting as a manual control device will be described next. As shown in FIG. 11, the second control valve 208 is switchable by a control mechanism 215 comprising a double-acting control cylinder. A pilot valve 216 for supplying and exhausting pilot pressure oil to/from this cylinder 215 is mechanically connected through a link mechanism 14 to the first shift lever S1. The first shift lever S1 has a right swivel maximum stroke position R and a left swivel maximum stroke position L respectively corresponding to opposite stroke ends of the spool (not shown) of the pilot valve 216.

The first shift lever S1 has a potentiometer 16 disposed at a proximal end thereof for detecting a pivoting angle of the lever S1 and transmitting a detection signal to a control unit C. The control unit C transmits a control signal to the first control valve V1 for effecting flow control such that the greater angle the first lever S1 pivots right or left, the greater becomes the rate of oil flow to the second control valve 208. In other words, the greater angle the first lever S1 pivots right or left, the faster the swivel deck TT swivels. When the first shift lever S1 is rocked even a slight amount rightward or leftward from a neutral position N, namely the spool of the pilot valve 216 is operated even a little, the pilot pressure oil flows into the control cylinder 215 to switch the second control valve 208.

Means is provided for causing the second control valve 208, when the first shift lever S1 is returned to the neutral position, to return to its neutral position 208*a* with a delay. As shown in FIG. 11, the control cylinder 215 houses a pair of springs 215*a* for urging a piston rod 215*b* operatively connected to the second control valve 208 to a position corresponding to the neutral position 208*a* of the second control valve 208. A bypass line 222 extends between a pair of oil lines 220 and 221 extending from the pilot valve 216 to the control cylinder 215. This bypass line 222 includes a throttling portion acting as a delay means 223.

Assume that, in the above construction, the piston rod 215*b* of the control cylinder 215 is in a leftward position in FIG. 11 with the first shift lever S1 rocked to the right swivel position R (at this time, the second control valve 208 is in a right swivel position 208*b*). When the first shift lever S1 is returned to the neutral position N, the spring 215*a* in the control cylinder 215 urges the piston rod 215*b* to return to the position corresponding to the neutral position 208*a* of the second control valve 208. This results in a force prompting the pilot oil in the control cylinder 215 to flow out from adjacent the righthand spring 215*a* through the bypass line 222 into the cylinder 215 adjacent the lefthand spring 215*a*. However, the throttling portion 223 applies a resistance to such flow of the pilot oil. As a result, the piston rod 215*b* moves rightward in FIG. 11 relatively slowly to the position corresponding to the neutral position of the second control valve 208. With this movement, the second control valve 208 returns to the neutral position 208*a*.

Until the second control valve 208 is completely returns to the neutral position 208*a*, pressure oil is supplied from the second control valve 208 to the hydraulic motor M1. Thus, the control unit C causes the first control valve V1 to gradually move in a flow reducing direction from the time the first shift lever S1 is operated to the neutral position N till the time the second control valve 208 is fully returned to the neutral position 208*a*. Consequently, the swivel deck TT is decelerated until it stops with the full return to the neutral position 208*a* of the second control valve 208. In this embodiment, the second control valve 208, control cylinder 215 and pilot valve 216 constitute the second control mechanism VV.

A further structure for achieving the same object as the fourth embodiment will be explained below as a fifth embodiment of the invention. The fifth embodiment includes a single pilot valve corresponding to the pilot portion of the second control mechanism in the fourth embodiment.

Figure 12:
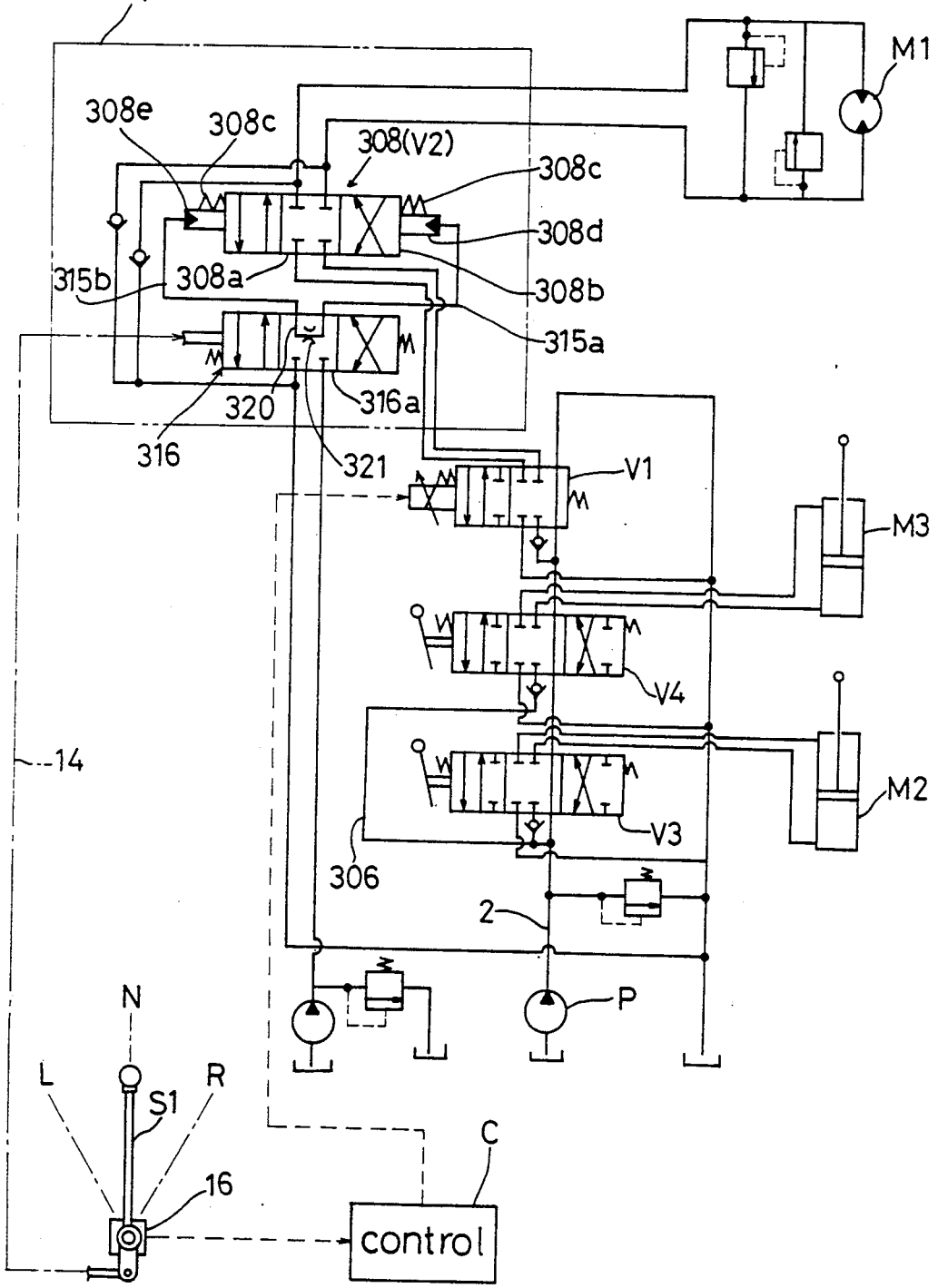
FIG. 12 is a diagram showing a hydraulic circuit according to a fifth embodiment and an interlocking relationship between the first shift lever and the valves.

Referring to FIG. 12, as in the fourth embodiment, pressure oil is supplied from a pump P through an oil line 2 and a branched oil line 306 to a first control valve V1 comprising an electromagnetic proportional reduction valve, a pilot-operable second control valve 308 and a fourth control valve V4 connected in series. As in the foregoing embodiment, the second control valve 308 determines the swiveling direction of the swivel deck TT by switching pressure oil supplying and exhausting directions for a hydraulic motor M1. The second control valve 308 is urged to a neutral position 308*a* by a pair of springs 308*c*. In this embodiment too, the first control valve V1 controls the rate of oil flow to the second control valve 308 for varying the swivel speed.

An interlocking structure for connecting the first and second control valves V1 and 308 to a first shift lever S1 acting as a manual control device will be described next. As shown in FIG. 12, the second control valve 308 is switchable by a pilot valve 316 which supplies and exhaust pilot pressure oil to/from the second control valve 308. This pilot valve 316 is mechanically connected through a link mechanism 14 to the first shift lever S1. The first shift lever S1 has a right swivel maximum stroke position R and a left swivel maximum stroke position L respectively corresponding to opposite stroke ends of the spool (not shown) of the pilot valve 316.

The first shift lever S1 has a potentiometer 16 disposed at a proximal end thereof for detecting a pivoting angle of the lever S1 and transmitting a detection signal to a control unit C. The control unit C transmits a control signal to the first control valve V1 for effecting flow control such that the greater angle the first lever S1 pivots right or left, the greater becomes the rate of oil flow to the second control valve 308. In other words, the greater angle the first lever S1 pivots right or left, the faster the swivel deck TT swivels. When the first shift lever S1 is rocked even a slight amount rightward or leftward from a neutral position N, namely when the spool of the pilot valve 316 is operated even a little, the pilot pressure oil flows into one of pilot control sections 308*d* and 308*e* of the second control valve 308 to switch the latter.

Means for causing the second control valve 308, when the first shift lever S1 is returned to the neutral position, to return to its neutral position 308*a* with a delay will be described next. As shown in FIG. 12, a pair of oil lines 315*a* and 315*b* extend from the pilot valve 316 to the pilot control sections 308*d* and 308*e* of the second control valve 308. The oil lines 315*a* and 315*b* are interconnected by a bypass line 320 in a neutral position 316*a*. The bypass line 320 includes a throttling portion 321.

Assume that, in the above construction, the pilot pressure oil is supplied to the righthand pilot control section 308*d* and the second control valve 308 is switched to a right swivel position 308*b* with the first shift lever S1 rocked to the right swivel position R. When the first shift lever S1 is returned to the neutral position N, the pilot valve 316 immediately returns to the neutral position 316*a*. As a result, the second control valve 308 is urged rightward in FIG. 12 by the lefthand spring 308*c*.

This results in a force prompting the pilot oil to flow from the right pilot control section 308*d* through the oil lines 315*a* and 315*b* and the bypass line 320 into the left pilot control section 308*e*. However, the throttling portion 321 of the bypass line 320 applies a resistance to such flow of the pilot oil. As a result, the second control valve 308 returns relatively slowly to the neutral position 308*a*.

Until the second control valve 308 is completely returns to the neutral position 308*a*, pressure oil is supplied from the second control valve 308 to the hydraulic motor M1. Thus, the control unit C causes the first control valve V1 to gradually move in a flow reducing direction from the time the first shift lever S1 is operated to the neutral position N till the time the second control valve 308 is fully returned to the neutral position 308*a*. Consequently, the swivel deck TT is decelerated until it stops with the full return to the neutral position 308*a* of the second control valve 308. In this embodiment, the second control valve 308 and pilot valve 316 constitute the second control mechanism VV.

Figure 5:
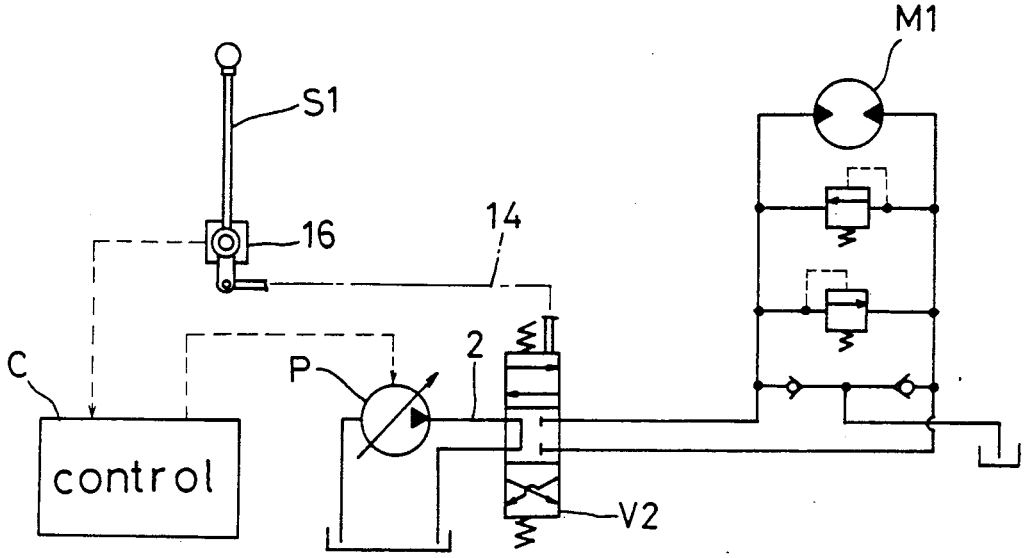
FIG. 5 is a view showing a modification of the hydraulic circuit according to the first embodiment.
Figure 6:
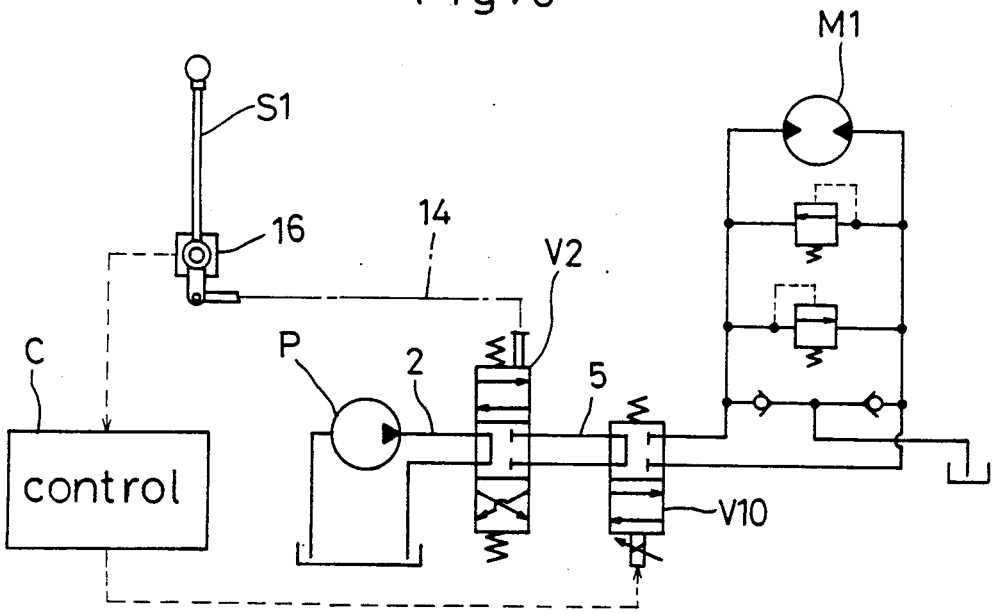
FIG. 6 is a view showing a further modification of the hydraulic circuit according to the first embodiment.

The described structures may be modified such that, as shown in FIG. 5, the pump P comprises the variably delivery type acting as the flow control means, with the operating speed of hydraulic motor M1 controllable by varying displacement of the pump P. As the first control valve, a duty-controlled electromagnetic switch valve or an electromagnetic proportional reduction valve may be selected for any of the described embodiments as desired. FIG. 6 shows an example where the flow control is effected by an electromagnetic proportional reduction valve V10 in place of the switch valve V1 in the first embodiment.

The present invention is applicable also to a structure employing a hydraulic cylinder instead of the hydraulic motor as the hydraulic actuator M1.

What is claimed is:

1. A hydraulic circuit structure for a working vehicle including a swivel deck comprising:

a hydraulic actuator operable to rotate said swivel deck, a first control valve (V) for controlling a rate of oil flow to said hydraulic actuator to set a swivel speed of said swivel deck, a second control mechanism connected in series to said first control valve for switching an operating direction of said hydraulic actuator, a manual control device (S1) operatively connected to said first control valve and said second control mechanism, maximum swivel speed setting means including:

a setter (19) for setting a maximum swivel speed, a comparator for comparing a first swivel speed value input from said setter (19) with a second swivel speed value input from said manual control device (S1), and means for generating a swivel speed signal to said first control valve (V1), said means generating a swivel speed signal based on the second swivel speed value unless the second swivel speed value exceeds the first swivel speed value, while generating a swivel speed signal based on the first swivel speed value when the second swivel speed value exceeds the first swivel speed value, wherein the greater amount said manual control device is operated from a neutral position, to the greater extent said first control valve is shifted in a flow increasing direction, and said second control mechanism is operable to switch oil lines in a predetermined direction in response to an operation of said manual control device.

2. A hydraulic circuit structure as claimed in claim 1, wherein said second control mechanism comprises a second control valve, said first control valve being operable after said second control valve is opened to a predetermined degree.

3. A hydraulic circuit structure as claimed in claim 1, wherein said maximum swiveling speed is provided whenever said manual control device is in a maximum shift position.

4. A hydraulic circuit structure as claimed in claim 1, wherein the swiveling speed is increased in proportion to an amount of operation of said manual control device.

5. A hydraulic circuit structure as claimed in claim 1, wherein said second control mechanism includes a first switch valve for receiving pressure oil from a pump and supplying the pressure oil for forward rotation, and a second switch valve for receiving the pressure oil from said pump and supplying the pressure oil for backward rotation, said manual control device and said second control mechanism being interlocked such that, when one of said switch valves is shifted to an oil supplying direction, said one of the switch valves is retained in the oil supplying direction and, when the other switch valve is shifted to the oil supplying position, said one of the switch valve is shifted to a closed position, and wherein said manual control device is connected to a control unit for controlling said first control valve from a point of time at which said manual control device is returned to the neutral position, thereby to cause said first control valve to shift gradually in a flow reducing direction to a flow stopping position.

6. A hydraulic circuit structure as claimed in claim 1, wherein said second control mechanism includes delay means for shifting said second control mechanism to neutral after lapse of a predetermined time from a point of time at which said manual control device is operated to the neutral position, said first control valve being gradually shiftable in a flow reducing direction during said predetermined time.

7. A hydraulic circuit structure as claimed in claim 6, wherein said second control mechanism further includes a directional control valve acting as a second control valve switchable by a double-acting control cylinder, a pilot valve connected to said manual control device for switching said control cylinder, and a pair of oil lines extending between said control cylinder and said pilot valve, said delay means being in form of a throttle member disposed between said pair of oil lines.

8. A hydraulic circuit structure as claimed in claim 6, wherein said second control mechanism further includes a pilot-controlled, neutral-restoring type direction control valve acting as a second control valve, a pilot valve connected to said manual control device for supplying and exhausting direction-switching pilot pressure oil to/from said direction control valve, said delay means being included in said pilot valve in form of a throttle member for applying a resistance to the pilot pressure oil.

9. A hydraulic circuit structure as claimed in claim 1 wherein said first control valve is an electromagnetic proportional reduction valve.

10. A hydraulic circuit structure as claimed in claim 1 wherein said hydraulic circuit structure as claimed in claim 1 includes a pump.

11. A hydraulic circuit structure as claimed in claim 10 wherein said pump is a variable pump.

12. A hydraulic circuit structure as claimed in claim 9 wherein said hydraulic circuit structure as claimed in claim 1 includes a pump.

13. A hydraulic circuit structure as claimed in claim 12 wherein said pump is a variable pump.

* * * * *